United States Patent [19]

Koizumi et al.

[11] Patent Number: 4,664,501

[45] Date of Patent: May 12, 1987

[54] METHOD OF AND APPARATUS FOR PRODUCING DUPLICATES IN COLOR

[75] Inventors: Yutaka Koizumi, Kawasaki; Hideya Furuta, Yokohama; Yoshihiro Sakai; Mitsuru Mamizuka, both of Tokyo; Tsukasa Adachi, Tokyo; Itsuo Ikeda, Sagamihara; Katsuo Sakai, Yokohama, all of Japan

[73] Assignee: Ricoh Company, Ltd., Tokyo, Japan

[21] Appl. No.: 811,942

[22] Filed: Dec. 20, 1985

[30] Foreign Application Priority Data

Dec. 25, 1984 [JP] Japan ..... 59-272052

[51] Int. Cl.[4] ..... G03G 15/01

[52] U.S. Cl. ..... 355/4

[58] Field of Search ..... 355/4, 3 R, 8, 1; 346/157

[56] References Cited

U.S. PATENT DOCUMENTS

| | | | |
|---|---|---|---|
| 4,239,370 | 12/1980 | Kurita | 355/4 |
| 4,429,986 | 2/1984 | Abe et al. | 355/8 |
| 4,610,529 | 9/1986 | Koizumi | 355/4 |

FOREIGN PATENT DOCUMENTS

| | | | |
|---|---|---|---|
| 57-85066 | 5/1982 | Japan | 355/4 |
| 59-111653 | 6/1984 | Japan | 355/4 |

*Primary Examiner*—Arthur T. Grimley
*Assistant Examiner*—J. Pendergrass
*Attorney, Agent, or Firm*—Cooper, Dunham, Griffin & Moran

[57] ABSTRACT

A method of and an apparatus for producing duplicates of a document in color wherein a plurality of photosensitive members in drum form are rotated in the same direction and exposed to respective color-separated optical images of the document through respective arrays of gradient-index rod lenses to form electrostatic latent images on the photosensitive members while the document is supported on a document support member and moved in the same direction as the rotation of the photosensitive drums. The electrostatic latent images on the photosensitive members are developed in different colors into visible images of different colors which are printed by transfer-printing on a sheet of support material on a transfer-printing belt moved in a direction opposite the direction of movement of the document support member for light exposure of the photosensitive members. The speed at which the document support member is moved to its starting position in return movement is lower than the speed at which it starts from its starting position for light exposure of the photosensitive members.

6 Claims, 4 Drawing Figures

METHOD OF AND APPARATUS FOR PRODUCING DUPLICATES IN COLOR

FIELD OF THE INVENTION AND RELATED ART STATEMENT

This invention relates to a method of and an apparatus for producing duplicates of a document in color by exposing each one of a plurality of photosensitive members to one of a plurality of color-separated optical images of the document to produce a plurality of electrostatic latent images of the document which are developed separately by using developing agents of different colors to produce developed images which are superposed one over another on a single sheet of support material and printed by transfer-printing to thereby produce a duplicate of the document in color.

In one type of copying apparatus suitable for carrying the aforesaid copying method into practice, a plurality of photosensitive members or three photosensitive members, for example, are located below a movable document support member and oriented in the direction of movement thereof, and an array of gradient-index rod lenses is interposed between the path of movement of the document support member and each one of the photosensitive members. In this copying apparatus, a plurality of color-separated optical images of the document or a plurality of optical images reflected by the document when the document is separately illuminated by red-, green- and blue-color emitting light sources, for example, are projected against the respective photosensitive members through the respective arrays of gradient-index rod lenses to expose the photosensitive members and form thereon three electrostatic latent images corresponding in color to the respective color-separated optical images of the document. The electrostatic latent images thus produced which differ from each other in color are each developed with a developing agent of a color complementary with one of the three different colors used in illuminating the document to produce developed or visible images which are superposed one over another on a single sheet of support material and printed by transfer-printing to provide a duplicate of the document in color.

When the operation of producing a duplicate of a document in color is performed by the copying method noted hereinabove, no variations should occur in the size of the regions of the visible images or the regions of the electrostatic latent images formed on the respective photosensitive members because the visible images are superposed one over another on the sheet of support material when transfer-printing is performed. The array of grdient-index rod lenses has the effect of avoiding the occurrence of a variation in the size of the regions of the electrostatic latent images. That is, the use of the array of gradient-index rod lenses enables a latent image of exactly the same size as the image of the document to be obtained, so that an electrostatic latent image of exactly the same size as the image of the document can be formed on each photosensitive member. When the electrostatic latent images of exactly the same size as the image of the document are developed into visible images and printed by transfer-printing on a sheet of support material, variations in the size of the regions of the visible images are wholly eliminated and the duplicate of the document in color thus obtained is high in quality because there are no variations in the positions of the visible images of different colors.

Generally, when an array of gradient-index rod lenses is used to expose a photosensitive member to an optical image of a document to form an electrostatic latent image of the document on the photosensitive member, the image formed is in mirror-image relation to the image of the document. When the electrostatic latent image is formed on the photosensitive member by moving the document, a portion of the photosensitive member on which the electrostatic latent image is formed or an area of the photosensitive member which is exposed to an optical image should move in the same direction as the document because the image is not inverted with respect to the direction of movement of the document. It has hitherto been usual practice, when a duplicate of a document is produced in color, to use the following process to successively form latent images and visible images of the document on respective photosensitive members and print the visible images on a sheet of support material by transfer-printing while meeting the aforesaid requirement of moving the exposed area of each photosensitive member in the same direction as the document, so that the duplicate produced has no variations in the size of the regions of the colors.

In the process used, a mirror is mounted between the emerging end of each array of gradient-index rod lenses and each photosensitive member to expose the photosensitive member to an optical image of the document and form an electrostatic latent image which is inverted with respect to the direction of movement of the document. The electrostatic latent images formed in this way are developed into visible images which are printed on a preliminary transfer-printing member to produce a duplicate of the document in color which is then printed in one operation on a sheet of support material by transfer-printing. The problems encountered in this process are that the use of the preliminary transfer-printing member increases the overall size of the copying apparatus, and the need to perform preliminary transfer-printing might reduce the quality of the duplicate of the document in color because of a possible lack of proper shading in the color image.

Another problem encountered in this process is that, when images in three different colors are printed on a sheet of support material by transfer-printing in one operation to form a desired image of the document (in this case, each color constitutes one toner layer when a toner is used for developing, so that the image has three toner layers), the lowermost toner layer has a lower transfer-printing rate than the two toner layers above the lowermost toner layer, with the result that the duplicate of the document in color obtained lacks balance in color and its shade is unsatisfactory.

OBJECT AND SUMMARY OF THE INVENTION

This invention has been developed for the purpose of obviating the aforesaid problems of the prior art. Accordingly, the invention has as its object the provision of a method of and an apparatus for producing duplicates of a document in color enabling high-quality duplicates of the document to be produced in color by using a copying apparatus of compact size.

The aforesaid object is accomplished according to the invention by producing a duplicate of a document by using a plurality of photosensitive members, located in spaced side-by-side relation and rotated in the same direction as the document is moved, which are each successively exposed through an array of gradient-index rod lenses to one of a plurality of color-separated optical images of the document obtained by color separation, to form on the respective photosensitive members a plurality of electrostatic latent images each corresponding to one of the color-separated optical images which are then developed by using developing agents of different colors into visible images which are printed in superposed relation by transfer-printing in an order opposite the order in which the photosensitive members were exposed to the color-separated optical images of the document on a sheet of support material conveyed by a transfer-printing belt moved in a direction opposite the direction of rotation of the photosensitive members.

DESCRIPTION OF THE PREFERRED EMBODIMENTS

A preferred embodiment of the invention will be described by referring to the accompanying drawings.

Figure 1:
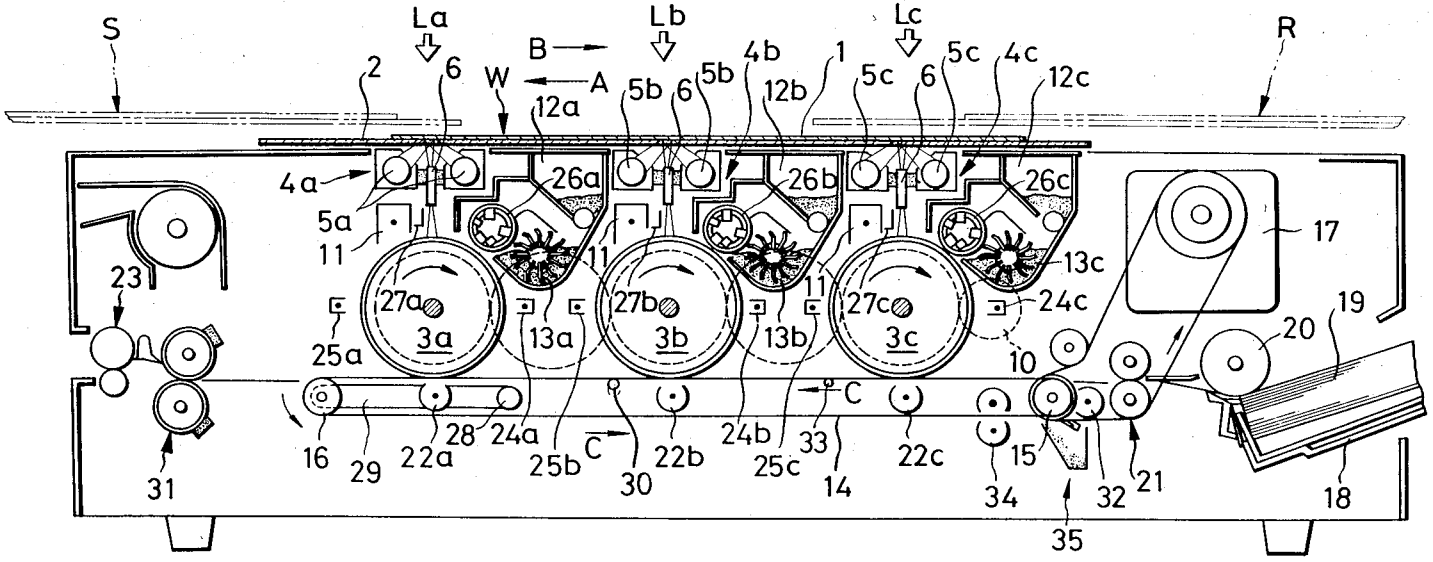
FIG. 1 is a sectional side view of a color copying apparatus suitable for use in carrying the method of producing duplicates in color according to the invention.

FIG. 1 shows a color copying apparatus suitable for carrying the method of producing duplicates in color according to the invention in a sectional side view. As shown, a document 1 carrying an image in color is placed on a document support member 2, which is formed of transparent material, with the image-carrying surface facing downwardly. When the copying apparatus is in a standby mode in which no copying operations are performed, the document support member 2 is in a standby position W shown in solid lines. However, when a copying operation is commenced the document support member 2 moves leftwardly in the figure as indicated by an arrow A to a starting position S indicated by phantom lines. The document support member 2 in the starting position S then moves rightwardly in the figure as indicated by an arrow B until it reaches a return position R indicated by phantom lines, when it alters the direction of its movement and moves in the direction indicated by the arrow A until it returns to the standby position W. To facilitate understanding, the starting position S and return position R are shown above the actual path of movement of the document support member 2.

A first photosensitive member 3*a*, a second photosensitive member 3*b* and a third photosensitive member 3*c* are located in spaced apart relation in a row below the document support member 2 in the indicated order from left to right in the figure. A first exposing device 4*a*, a second exposing device 4*b* and a third exposing device 4*c* are interposed between the path of movement of the document support member 2 and the first to third photosensitive members 3*a*–3*c* which are each in the form of a drum, with the distance between the axes of the drums being one-half the peripheral length of each drum. The exposing devices 4*a*, 4*b* and 4*c* are equipped with lamps 5*a*, 5*b* and 5*c* respectively and each have an array of gradient-index rod lenses 6. The lamp 5*a* of the first exposing device 4*a* serves as a red-light emitting light source, the lamp 5*b* of the second exposing device 4*b* as a green-light emitting light source and the third exposing device 4*c* as a blue-light emitting light source.

As the document support member 2 moves from the starting position S in the direction of the arrow B, the document 1 on the document support member 2 is successively illuminated by the first to third lamps 5*a*–5*c* and the light beams from the first to third lamps 5*a*–5*c* are reflected by the document 1 and projected through the respective arrays of gradient-index rod lenses 6 of the exposing devices 4*a*–4*c* against the photosensitive members 3*a*–3*c* respectively, to expose the respective photosensitive members 3*a*–3*c* to optical images of the document 1. At this time, the first to third lamps 5*a*–5*c* emit red-, green- and blue-light beams respectively, so that the light beams reflected by the document 1 are each separated into one of the color components of the document 1. Thus, the photosensitive members 3*a*, 3*b* and 3*c* are exposed to color-separated optical images or optical images reflecting red-, green- and blue-light radiations respectively. In this specification, the color-separated optical image is defined as being one of the optical images of the document 1 having an image component reflecting red-, green- and blue-light radiations respectively.

Electrostatic latent images formed on the photosensitive members 3*a*–3*c* through the respective arrays of gradient-index rod lenses 6 are in mirror-image relation to the image of the document 1 on the image support member 2, and the images are not inverted with respect to the direction of movement B of the document 1. Thus, to enable the normal electrostatic latent images to be formed consecutively on the photosensitive members 3*a*–3*c*, it is essential that exposed areas of the photosensitive members 3*a*–3*c* should move in the same direction as the document 1. To this end, the photosensitive members 3*a*–3*c* are driven for rotation clockwise in FIG. 1.

Figure 2:
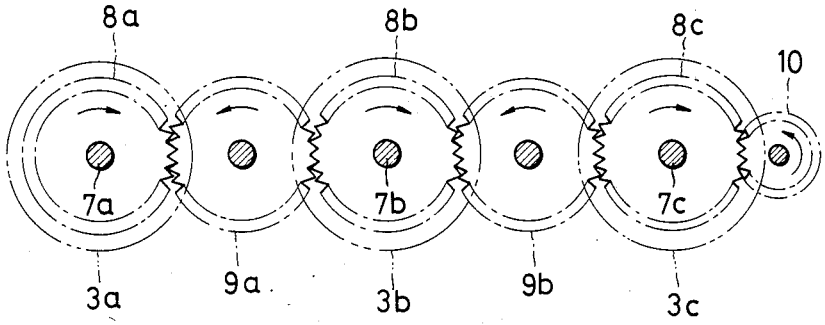
FIG. 2 is a view of means for driving the photosensitive members of the color copying apparatus shown in FIG. 1.

FIG. 2 shows one example of drive means for driving the photosensitive members 3*a*–3*c* to rotate as described hereinabove. In this example, the photosensitive members 3*a*, 3*b* and 3*c* have rotary shafts 7*a*, 7*b* and 7*c* supporting gears 8*a*, 8*b* and 8*c* of the same diameter respectively. The gears 8*a*–8*c* are connected together by intermediate gears 9*a* and 9*b* of the same diameter as the gears 8*a*–8*c*, and a drive gear 10 meshing with the gear 8*c* supported by the drive shaft 7*c* of the third photosensitive member 3*c* drives the gears 8*a*–8*c*, 9*a* and 9*b* for rotation. When the drive shaft 10 rotates counterclockwise in FIG. 2, the gears 8*a*–8*c* supported by the rotary shafts 7*a*–7*c* of the photosensitive members 3*a*–3*c* respectively all rotate clockwise, to thereby cause the photosensitive members 3*a*–3*c* to rotate clockwise.

The photosensitive members 3*a*–3*c* rotating clockwise are each uniformly charged by a charger 11 located on the upstream side of the exposed area of each of the photosensitive members 3*a*–3*c* (on the left side of each photosensitive member in FIG. 1) to electrically charge the surface of the photosensitive member before being exposed to the respective color-separated optical images of the document 1 by the exposing devices 4*a*–4*c*. As the electrically charged photosensitive members 3*a*–3*c* are exposed to the color-separated optical images of the document 1 by the exposing devices 4*a*–4*c* *a* respectively, electrostatic latent images are formed in the exposed areas of the surfaces of the photosensitive members 3a–3c and move with the clockwise rotation of the photosensitive members 3a–3c to positions in which the electrostatic latent images face developing devices 12a, 12b and 12c respectively. Of these developing devices, the first developing device 12a corresponding to the first photosensitive member 3a exposed to the color-separated optical image reflecting the red-light radiation has a developing agent 13a of cyan color which is complementary with the red color; the second developing device 12 corresponding to the second photosensitive member 3b exposed to the color-separated optical image reflecting the green-light radiation has a developing agent 13b of magenta color which is complementary with the green color; and the third developing device 12a corresponding to the third photosensitive member 3c exposed to the color-separated optical image reflecting the blue-light radiation has a developing agent 13c of yellow color which is complementary with the blue color. Thus, the electrostatic latent images are individually developed, when positioned against the developing devices 12a–12c, into visible images of cyan, magenta and yellow colors respectively. As a result, the visible image produced by developing the electrostatic latent image on the first photosensitive member 3a has a cyan component of the image of the document 1; the visible image produced by developing the electrostatic latent image on the second photosensitive member 3b has a magenta component of the image of the document 1; and the visible image produced by developing the electrostatic latent image on the third photosensitive member 3c has a yellow component of the image of the document 1.

In the embodiment shown and described hereinabove, the distance between illuminating positions La, Lb and Lc is set at the same value as the distance between the center axes of the photosensitive members 3a, 3a and 3c which is equal to one-half the peripheral length of the photosensitive members 3a–3c. Thus, when the document 1 has moved to the second illuminating position Lb and the exposing of the second photosensitive member 3b to a color-separated optical image of the document 1 is started after first photosensitive member 3a is exposed to a color-separated optical image of the document 1 in the first illuminating position La, the leading end of an electrostatic latent image on the first photosensitive member 3a has already made one-half revolution and the developing of the electrostatic latent image has already been performed by the first developing device 12a to produce a visible image. Likewise, when the document 1 has moved from the second illuminating position Lb to the third illuminating position Lc and the exposing of the third photosensitive member 3c to a color-separated optical image of the document 1 is started, the leading end of the visible image on the first photosensitive member 3a has already made one complete revolution and the visible image on the second photosensitive member 3b has already made one-half revolution. In this way, electrostatic latent images are successively formed on the first photosensitive member 3a, second photosensitive member 3b and third photosensitive member 3c in the indicated order with a time lag corresponding to one-half the peripheral length of the photosensitive members 3a–3c. The electrostatic latent images thus formed are developed into visible images with a like time lag.

A transfer-printing belt 14 formed of thin polyester film, for example, is located below the first to third photosensitive members 3a–3c and trained over a drive roller 15 located on the right side in FIG. 1 and a follower roller 16 located on the left side in the same figure. A drive motor 17 drives the drive roller 15 for rotation to move the transfer-printing belt 14 in the direction of an arrow C. A sheet feeding cassette 18 located rightwardly of the transfer printing belt 14 supports thereon a plurality of sheets of support material 19 serving as transfer-printing sheets which are each fed by a sheet feeding roller 20 and register rollers 21 to an upper run of the transfer-printing belt 14 and moved thereby in the direction of the arrow C as the belt 14 moves in this direction. During the movement of the sheet of the support material 19 in the direction of the arrow C, it is successively brought into index with the third photosensitive member 3c, second photosensitive member 3b and first photosensitive member 3a in the indicated order. Each time the sheet of support material 19 is brought into index with one of the three photosensitive members 3c–3a, the visible image on one of the three photosensitive members 3c–3a is printed by transfer-printing on the sheet of support material 19 under the action of one of the three transfer-printing chargers 22c–22a, so that a plurality of visible imges are printed in superposed relation on the sheet of support material 19.

Charge removing lamps 24a, 24b and 24a located upstream of the transfer-printing chargers 22c, 22b and 22a respectively with respect to the direction of rotation of the photosensitive members 3c, 3b and 3a perform the function of lowering the electric potential of the respective photosensitive members. Charge removing lamps 25c, 25b and 25a located downstream of the transfer-printing chargers 22c, 22b and 22a respectively perform the function of removing residual electric charges from the photosensitive members 3c, 3b and 3a after the transfer-printing of the visible images of the sheet of support material 19 is finished, to get the photosensitive members 3a–3c to be ready for the next following cleaning operation. In the embodiment shown and described hereinabove, the cleaning operation is performed by switching the bias voltage impressed on developing sleeves 26c, 26b and 26a of the developing devices 12c, 12b and 12a from a developing level to a cleaning level.

After the visible images have successively been printed by transfer-printing on the sheet of support material 19 in superposed relation from the third to first photosensitive members 3c–3a, the sheet of support material 19 is separated from the upper run of the transfer-printing belt 14 in a condition of curvature separation by the action of the curvature of the follower roller 16 and fed to a pair of fixing rollers 31 which fix the visible images to provide a duplicate of the document 1 in color as desired. Thereafter, the duplicate of the document 1 thus provided is ejected from the apparatus to outside by a pair of ejecting rollers 23.

The register rollers 21 perform the following function. The sheet of support material 19 fed from the sheet feeding cassette 18 by the sheet feeding roller 20 is temporarily brought to a halt and then fed to the upper run of the transfer-printing belt 14 in timed relation to the formation of an electrostatic latent image on the third photosensitive member 3c in such a manner that the leading end of a visible image formed on the third photosensitive member 3c by developing the electrostatic latent image coincides with a position on the sheet of support material 19 in which the leading ends of the three visible images are desired to be located. Thus, the visible image on the third photosensitive member 3c is printed by transfer-printing in a desired position on the sheet of support material 19 when the third photosensitive member 3c is brought to a transfer-printing position (a position in which transfer-printing is effected by the transfer-printing charger 22c).

As described hereinabove, electrostatic latent images are successively formed on the first to third photosensitive members 3a–3c with a time lag corresponding to one-half the peripheral length of the photosensitive members 3a–3c, so that the visible images produced by developing the electrostatic latent images by the developing devices 12a–12c also have a like time lag. When this time lag in the formation of one visible image on one photosensitive member behind the formation of another visible image on another photosensitive member is viewed in a reverse order or from the third photosensitive member 3c toward the second photosensitive member 3b and from the second photosensitive member 3b toward the first photosensitive member 3a, it is nothing more nor less than the advance of one visible image before another visible image by an extent corresponding to one-half the peripheral length of the photosensitive members 3a–3c. The distance between the transfer-printing positions of the adjacent photosensitive members is equal to one-half the peripheral length of the photosensitive members 3a–3c. This enables the visible images printed by transfer-printing from the photosensitive members 3c–3a on the sheet of support material 19 to be formed in superposed relation with no variations in position.

In the color copying apparatus suitable for carrying the method of forming duplicates of an original in color according to the invention, the first photosensitive member 3a, second photosensitive member 3b and third photosensitive member 3c are successively exposed to color-separated optical image of the document 1 in the indicated order, and the visible images produced on the photosensitive members 3a–3c are printed by transfer-printing on the sheet of support material 19 by reversing the order or starting with the third photosensitive member 3c and ending with the first photosensitive member 3a. Thus, the need to mount a mirror between each array of gradient-index rod lenses and each photosensitive member to reverse the direction of movement of an optical image and to print a visible image from each photosensitive member on a preliminary transfer-printing member can be eliminated. This simplifies the printing mechanism of the copying apparatus, thereby enabling an overall compact size to be obtained in a color copying apparatus.

Figure 3:
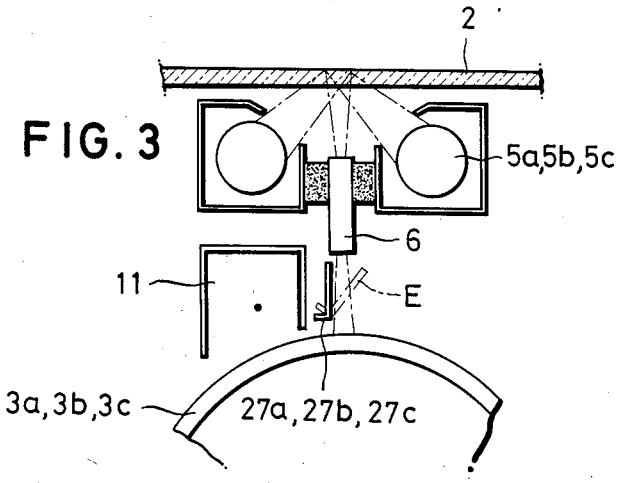
FIG. 3 is a view, on an enlarged scale, of the exposing device of the color copying apparatus shown in FIG. 1.

As can be clearly understood from the foregoing description, the photosensitive members 3a–3c each make four complete revolutions from the time the operation of exposing the photosensitive members 3a–3c to color-separated optical images of the document 1 by starting with the first photosensitive member 3a is commenced until the time the operation of printing by transfer-printing on the sheet of support material 19 the visible images from the photosensitive members 3c–3a by ending with the first photosensitive member 3a is finished. After being exposed to a color-separated optical image of the document 1 and having the electrostatic latent image developed into a visible image while making a first complete revolution, the first photosensitive member 3a continues to rotate by retaining the visible image thereon until the operation of printing visible images by transfer-printing from the second and third photosensitive members 3b and 3c on the sheet of support material 19 is finished. During this period of time, the operation of developing the electrostatic latent image on the first photosensitive member may be performed a predetermined number of times. After being exposed to a color-separated optical image of the document 1 and having the electrostatic latent image developed while making first and second complete revolutions, the second photosensitive member 3b continues to rotate by retaining the visible image until the operation of printing a visible image from the third photosensitive member 3c on the sheet of support material 19 is finished. Likewise, the operation of developing the electrostatic latent image on the second photosensitive member 3b may be repeated a predetermined number of times. The photosensitive members which rotate by retaining the visible images should be prevented from being exposed to light radiations. To this end, shutters 27a, 27b and 27c are provided to exposing positions of the photosensitive members 3a, 3b and 3c respectively. Each of the shutters 27a–27c is moved to a position E, as shown in FIG. 3, in which it blocks a path of light from the respective array of gradient-index rod lenses 6 as soon as each photosensitive member is exposed to a color-separated optical image of the document 1. With regard to the third photosensitive member 3c, the electrostatic latent image formed by exposure may be immediately printed by transfer-printing on the sheet of support material 19 after being developed by the developing device 12c. If this process is followed, then the need for the third photosensitive member 3c to retain the visible image as aforesaid can be eliminated. Thus, the operation of the shutter 27c is not essential.

Figure 4:
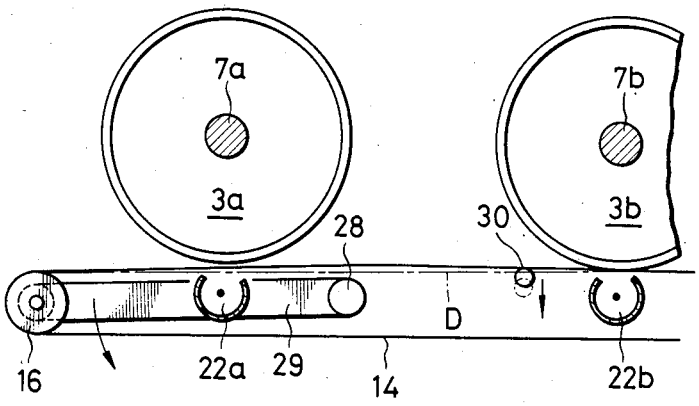
FIG. 4 is a view of the transfer-printing belt in contact with one of the photosensitive members but out of contact with another photosensitive member.

When a transfer-printing operation is performed, it is necessary that the photosensitive members 3a–3c and the transfer-printing belt 14 are maintained in contact with each other while the former rotate about their respective axes and the latter is driven for movement by the drive roller 15. However, when each photosensitive member 3a, 3b or 3c rotates while retaining a visible image as described hereinabove, it is not desirable that the photosensitive member be brought into contact with the transfer-printing belt 14. To this end, in the embodiment shown and described hereinabove, the transfer-printing charger 22a for the first photosensitive member 3a and the follower roller 16 for supporting the transfer-printing belt 14 are supported by an arm 29 pivoted at a shaft 28 secured to a machine frame, not shown, of the copying apparatus. When the arm 29 is slightly moved counterclockwise in pivotal movement in FIG. 4, the transfer-printing belt 14 can be brought out of contact with the first photosensitive member 3a as indicated by a solid line in the figure. A shaft 30 that can be moved vertically is located on the left side of the transfer-printing charger 22b for the second photosensitive member 3b and moved to an upper position to maintain the transfer-printing belt 14 in contact with the second photosensitive member 3b when the visible image is printed from the photosensitive member 3b on the sheet of support material 19. By moving the shaft 30 to a lower position indicated by a phantom line, the transfer-printing belt 14 can be moved downwardly to a phantom line position indicated by D in which it is brought out of contact with the second photosensitive member 3b.

In the embodiment shown and described hereinabove, the distance between the document illuminating positions La, Lb and Lc, the distance between the axes of the photosensitive members 3a, 3b and 3c, and the distance between the transfer-printing chargers 22a, 22b and 22c are all equal to one-half the peripheral length of the photosensitive members 3a–3c to avoid any variation that might otherwise occur in the position of the images printed by transfer-printing in superposed relation on the sheet of support material 19 from the visible images on the photosensitive members 3c–3a. However, the invention is not limited to this specific value of the distances, and these distances may have any value as desired so long as no trouble is encountered in avoiding variations in the position of the images superposed one over another by transfer-printing on the sheet of support material 19. For example, the distances may be made equal to the whole peripheral length of the photosensitive members 3a–3c.

In the embodiment shown and described hereinabove, the number of photosensitive members used is three. However, the invention is not limited to this specific number of photosensitive members. One type of copying apparatus has four photosensitive members including the three photosensitive members shown and described hereinabove and a photosensitive member for copying documents in black color. The invention can also have application in this type of copying apparatus.

In the embodiment shown and described hereinabove, the photosensitive members 3a–3c are connected together mechanically by the gears 8a–8c, 9a and 9b. This eliminates the need to provide a special control unit for controlling the synchronous operation of the photosensitive members 3a–3c, to achieve color matching when transfer-printing is performed.

In the embodiment shown and described hereinabove, the drive gear 10 drives the photosensitive members 3a–3c for rotation and the drive motor 17 drives the belt drive roller 15 to move the transfer-printing belt 14. That is, the photosensitive members 3a–3c and the transfer-printing belt 14 are driven by separate drive sources. However, the invention is not limited to this arrangement. A gear may, for example, be secured to a shaft of the belt drive roller 15 and kept in meshing engagement with an intermediate gear which in turn may be kept in meshing engagement with the drive gear 10. By this arrangement, it is possible to drive both the photosensitive members 3a–3c and the transfer-printing belt 14 by the drive gear 10. Needless to say, the drive motor 17 can be done without. By arranging the photosensitive members 3a–3c and the transfer-printing belt 14 to be driven as a unit, synchronization of the operations of the photosensitive members 3a–3c and the transfer-printing belt 14 can be facilitated.

A charging device 32 may be located rightwardly of the belt drive roller 15 made as of rubber to electrically charge the transfer-printing belt 14. By this arrangement, the sheet of support material 19 fed to the upper run of the transfer-printing belt 14 via the register rollers 21 can be conveyed while electrostatically attracting same to the transfer-printing belt 14, thereby avoiding possible variations in the position of the sheet of support material 19 on the transfer-printing belt 14.

To avoid the sagging of the transfer-printing belt 14, a support roll 33 may be advantageously mounted between the second and third photosensitive members 3b and 3c in addition to the shaft 30 that can be moved vertically as described hereinabove. The support roll 33 is moved upwardly before the sheet of support material 19 reaches the second photosensitive member 3b, to bring the sheet of support material 19 into contact with the second photosensitive member 3b with a good timing. When the conveying of the sheet of support material 19 is finished, the electric charge carried by the transfer-printing belt 14 is removed by a charge removing device 34 and the belt 14 is cleaned by a cleaning device 35.

The document support member 2 stops and returns to its original position during a transfer-printing operation, thereby causing fluctuations to occur in the load. The fluctuations in the load may cause jitters to occur resulting in variations in the position of images. To minimize fluctuations in the load during a return movement of the document support member 2 and avoid variations in the position of the images, the speed of movement of the document support member 2 to its original position may advantageously be made lower than the speed of movement thereof from its original position.

In the embodiment shown and described hereinabove, when the sheet of support material 19 reaches a position below a lower end of the third photosensitive member 3c, the leading end of the visible image of the document 1 reaches the same position as the sheet of support material 19. Thus, at this time, a central portion of the document 1 is in the exposing position, and when the trailing end of the document 1 is released from the exposing position, a central portion of the visible image of the document 1 is in the exposing position. Consequently, the time at which the return movement of the document support member 2 is initiated after it has passed by the final exposure position, stopped and altered the direction of its movement coincides with the time at which the visible image is printed by transfer-printing on the sheet of support material 19.

However, when the document support member 2 stops and changes the direction of its movement to return to its original position, fluctuations in the load take place. This might cause variations in the position of color-separated visible images when they are placed in superposed relation one over another and printed on the sheet of support material 19 by transfer-printing.

In color copying apparatus of the prior art, the document support member is returned to its original position at a speed higher than or equal to the speed at which it moves from its original position for light exposure of the photosensitive member.

In the present invention, the speed at which the document support member 2 moves to its starting position in return movement after light exposure of the final photosensitive member is effected is set at a level lower than the speed at which it starts from its starting position for light exposure of the photosensitive members, so long as the document support member 2 returns to its starting position before a signal for commencing the next following copying operation is generated. This lessens a load applied to the drive system and reduces fluctations in load.

From the foregoing description, it will be appreciated that the invention eliminates the need to use a mirror for inverting an optical image passed through an array of gradient-index rod lenses and a preliminary transfer-printing member. Thus, the invention enables an overall compact size to the obtained in a color copying apparatus by simplifying the construction. The use of no preliminary transfer-printing member allows a visible image to be directly printed by transfer-printing on a sheet of support material, thereby avoiding a reduction in the quality of duplicates of the document that might possibly occur when transfer-printing of images is repeated. In the present invention, the speed at which the document support member returns to its starting position is made lower than the speed at which a document support member returns to its starting position in conventional color copying apparatus (to be specific, the speed is reduced to about one-third), so long as the document support member returns to its starting position or starting position before the preparation for the next following copying operation is completed. This is conductive to minimization of occurrences of variations in the position of the visible images printed by transfer-printing on a sheet of support material which might be caused by fluctuations in the load taking place when the document support member changes the direction of its movement and returns to its starting position.

What is claimed is:

1. A method of producing duplicates of a document in color in which a plurality of photosensitive members arranged in a row and located in spaced side-by-side relation are rotated in the same direction to produce a duplicate of the document in color by the steps of:

placing the document on a document support member and moving said member in a scanning movement and, during said movement, illuminating the document and subjecting the document to color separation to produce a plurality of color-separated optical images which each expose, through an array of gradient-index rod lenses, one of the plurality of photosensitive members by starting with the photosensitive member located at one end of the row, to form on each said photosensitive member a non-inverted electrostatic latent image corresponding to one of the color-separated optical images, wherein the photosensitive members are exposed to said color-separated images in succession during said scanning movement of said document support member;

developing the electrostatic latent images in different colors into visible images; and printing the visible images by transfer-printing from the photosensitive members directly on a sheet of support material to print the visible images of different colors one over another in superposed relation by starting with the photosensitive member located at an end of the row opposite said one end, to thereby produce a duplicate of the document in color.

2. An apparatus for producing duplicates of a document in color comprising:

a plurality of photosensitive members in drum form arranged in a row in spaced side-by-side relation, and a plurality of drum gears which are the same in size and each of which is secured to a respective photosensitive member to rotate therewith, and a plurality of intermediate gears which are the same in size as said drum gears and are rotatably supported between the photosensitive members and each of which meshes with a respective pair of adjacent drum gears, said gears synchronizing the rotation of said photosensitive members;

a plurality of the sets each comprising a charging device, an exposing device, a developing device and a transfer-printing device, and each set cooperating with a respective one of said plurality of photosensitive members;

a document support member located on one side of said row of said plurality of photosensitive members to support the document for movement along said row of said plurality of photosensitive members; and a transfer-printing belt located on a side opposite said document support member with respect to said row of said plurality of photosensitive member to support a sheet of support material thereon;

wherein said plurality of photosensitive members are rotated in the same direction and the document support member is moved in the same direction as the rotation of the photosensitive members when the latter are exposed to color-separated optical image of the document while said transfer-printing belt is moved in a direction opposite the direction of movement of said document support member, and wherein the speed at which said document support member moves in return movement to its starting position after light exposure of the final photosensitive member is lower than the speed at which it starts from its starting position when the plurality of photosensitive members are exposed to the respective color-separated optical images of the document.

3. A color copier comprising:

means for moving a color original in forward scanning motion in a first direction and in return scanning motion in an opposite direction;

a plurality of photosensitive members arranged in succession along said first direction and having surface portions which face the original and move in said first direction during said forward scanning motion;

imaging means operative during said forward scanning motion to form color-separated images of the original and to project a respective one of said color-separated images on each of said photosensitive members at successive times to thereby form a respective latent image on each photosensitive member, wherein each latent image is a non-inverted image of a respective color component of the original;

image developing means for developing said latent images into developed images in respective colors;

image transfer means operative during at least a part of said return scanning motion to feed a copy medium in said opposite direction and cause said medium to successively contact said photosensitive members in an order opposite that in which said latent images were formed thereon, wherein in the course of each contact the developed image on the respective photosensitive member is transferred to the copy medium to thereby build up thereon a color image of the original comprising a superposition of the transferred developed images.

4. A color copier as in claim 3 in which each photosensitive member is a drum rotating in a first direction such that the peripheral velocity vector at its portion facing the original during the formation of said latent image thereon has a direction substantially parallel to said forward scanning direction, and including means for interlocking the drums to ensure that they rotate at the same speed.

5. A color copier as in claim 4 in which the return scanning motion takes place during at least a part of the operation of the image-transfer means to transfer at least one developed image to said copy medium, and the speed of the return scanning motion is less than the speed of the forward scanning motion.

6. A color copier as in claim 4 in which said interlocking means comprises a respective drum gear secured to each drum to rotate therewith and intermediate gears each rotatably supported between two adjacent drums and in mesh with the drum gears of the adjacent drums, wherein all gears have substantially the same diameter.

* * * * *